US008776102B2

(12) United States Patent
Brown

(10) Patent No.: US 8,776,102 B2
(45) Date of Patent: Jul. 8, 2014

(54) SYSTEM AND METHOD FOR EVALUATING AUDIENCE REACTION TO A DATA STREAM

(75) Inventor: Justin Brown, Fort Worth, TX (US)

(73) Assignee: AT&T Intellectual Property I, LP, Atlanta, GA (US)

( * ) Notice: Subject to any disclaimer, the term of this patent is extended or adjusted under 35 U.S.C. 154(b) by 936 days.

(21) Appl. No.: 11/869,514

(22) Filed: Oct. 9, 2007

(65) Prior Publication Data

US 2009/0094630 A1 Apr. 9, 2009

(51) Int. Cl.
*H04H 60/56* (2008.01)

(52) U.S. Cl.
USPC ..... 725/12; 725/9; 725/10

(58) Field of Classification Search
CPC ..... H04N 21/44213; H04N 21/44231
USPC ..... 725/9–16
See application file for complete search history.

(56) References Cited

U.S. PATENT DOCUMENTS 6,807,675 B1 * 10/2004 Maillard et al. ..... 725/35
6,873,710 B1 3/2005 Cohen-Solal
7,212,988 B1 5/2007 Feldten
2002/0072900 A1 * 6/2002 Keough et al. ..... 704/220
2003/0028872 A1 * 2/2003 Milovanovic et al. ..... 725/12
2003/0187733 A1 10/2003 Hertling
2004/0078820 A1 * 4/2004 Nickum ..... 725/58
2004/0117503 A1 * 6/2004 Nguyen et al. ..... 709/238
2005/0198661 A1 * 9/2005 Collins et al. ..... 725/19
2005/0223237 A1 * 10/2005 Barletta et al. ..... 713/186
2008/0222671 A1 * 9/2008 Lee et al. ..... 725/10

* cited by examiner

*Primary Examiner* — Nicholas Corbo
(74) *Attorney, Agent, or Firm* — G. Michael Roebuck

(57) ABSTRACT

A computer readable medium is disclosed containing a computer program useful for performing a method for estimating an audience reaction to a data stream, the computer program comprising but not limited to instructions to send data containing a plurality of filter objects data to a plurality of filtered sensors associated with end user devices, instructions to receive response data from the filtered sensor in response to the data stream in accordance with the plurality of filter objects and instructions to estimate an audience reaction to the video data from the response data. A system is disclosed including a processor for performing a method for estimating an audience reaction to video data. A data structure is disclosed for containing data useful for performing the computer program and method.

19 Claims, 6 Drawing Sheets

SYSTEM AND METHOD FOR EVALUATING AUDIENCE REACTION TO A DATA STREAM

FIELD OF THE DISCLOSURE

The present disclosure relates to the field of evaluating audience reaction to a data stream.

BACKGROUND OF THE DISCLOSURE

Historically, an operator of a test screening has selected particular people satisfying the demographics of the expected audience for the video and then has collected those selected people either in an auditorium for the viewing of the video or equivalent. This especially has been true for test screenings of motion picture type videos. Members of in the test audience are then asked to answer special questions about the video, usually presented to them on paper. The audience turn in their answers (on paper) to the test operator, who tabulates the results and supplies the results to the particular person or business that requested the test screening.

DETAILED DESCRIPTION

Figure 1:
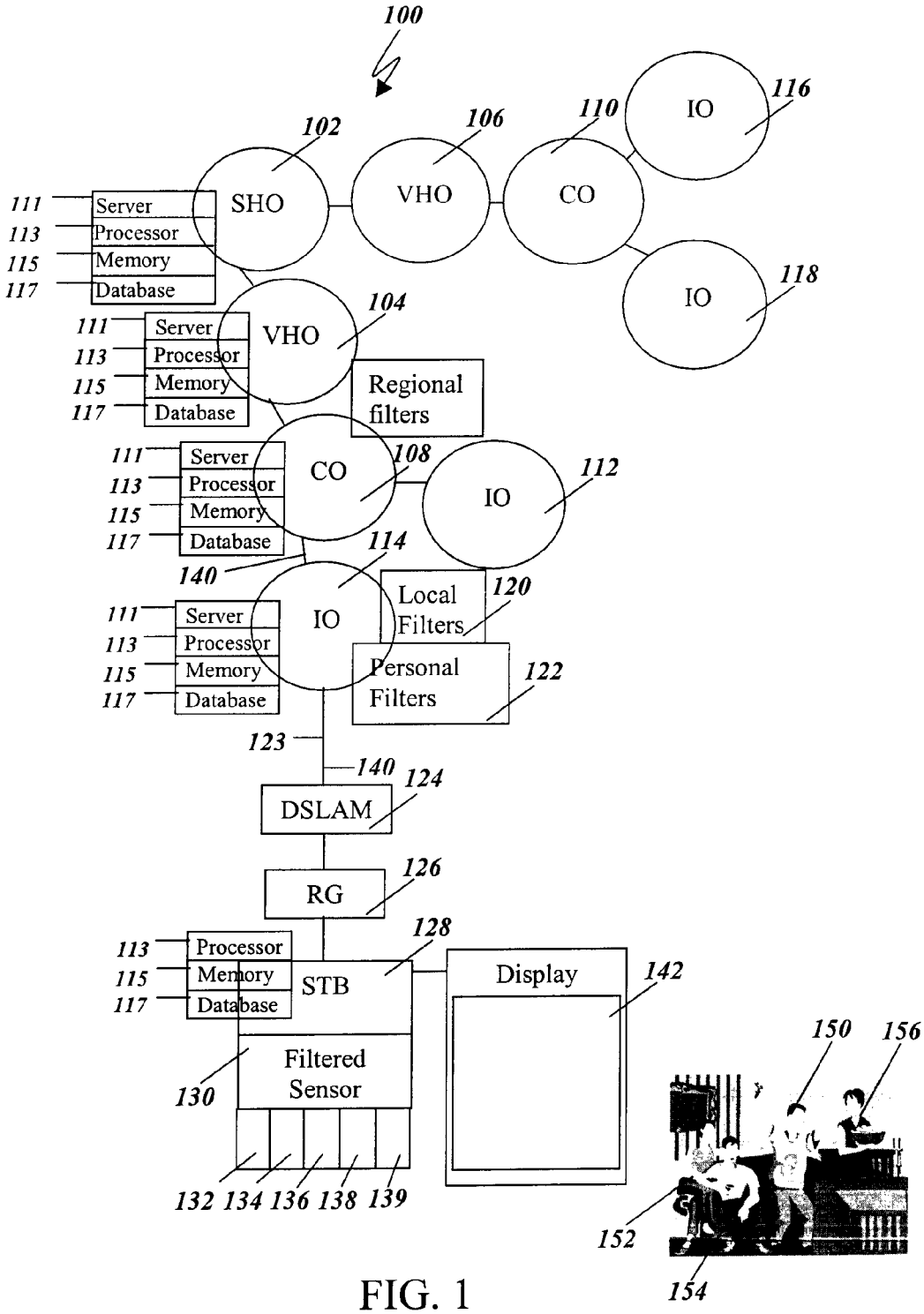
FIG. 1 depicts an illustrative embodiment of a system for evaluating an audience reaction to video data.

A system and method are disclosed by which audience reaction and demographic information can be ascertained and used to evaluate audience reactions to video data including programs and advertising. Audience members can be profiled by demographic factors and interest to provide targeted video content without the active participation of the targeted audience. A particular embodiment of the disclosed system and method provides automatic reaction and demographic identification down to a specific individual audience member level. An illustrative embodiment provides specific information on audience members by demographic factors and the audience member's specific reaction to particular events in the video data. An illustrative embodiment provide specific demographic data that selectively filters desired audience member responses from more general audience response data information that is more general than desired for audience response evaluation.

Another illustrative embodiment dynamically adjusts audience filters to capture responses from a group of particular audience members within an audience during a first video event in a video data stream and captures responses from another group of audience members in the same audience during a second video event in the same video data stream. For example, filters can be sent to a filtered sensor associated with end user device to capture women's reaction to a first joke at a first time in a video presentation and different filters sent to the filtered sensor to capture a man's reaction to a second joke at a second time in the same video data stream presentation. Filters can also be sent to the filtered sensor to separately capture the men's and women's reactions to the same joke in a video data stream presentation.

In another embodiment, filters are dynamically sent to a filtered sensor to accommodate changes in an audience member ship and changes in a desired target response. Another embodiment reacts to the fact that other demographics might be present in a location that is not characterized by its broader demographic characterization. Another embodiment automatically reacts generally to the fact that demographics in a specific location are not static, but change constantly. Thus, initially regional or local filters may be geared to a Hispanic demographic, however, additional filters can be sent when it is discovered that Chinese demographic audience members are present in an audience viewing the video data presentation.

In another illustrative embodiment, filtered sensor devices are provided for placement in a video provider's set top box. In another embodiment, the filtered sensor device captures audio, video and/or infrared data from an audience watching a video data presentation. The audio, video and/or infrared data are filtered and analyzed for demographic analysis to determine an audience reaction to the video data. In another embodiment, multiple directional audio devices such as a filtered sensor for triangulating the audio signals to determine a number of members in an audience. The audio, video or infrared data can be further analyzed to confirm such details as the number of people in the room, whether those individuals are stationary or moving, etc. In another embodiment, audio, infrared or video data is used to determine audience count and demographics for the audience members.

In another embodiment, the results of the audio demographic analysis are combined with the other ambient sound indications, such as back ground noise. A video provider can produce demographically targeted content based on the audience membership conditions recognized in real time. Further, by cataloguing the real time demographic data, patterns emerge that, over time, can be used to make decisions regarding content delivery and audience membership associated with a particular end user device. If a particular end user at a particular end user location is identified as a pet owner once, content specific to that pet owner demographic might be rated as a lower priority, whereas a location identified as a pet owner demographic on a daily basis would increase the priority of content targeted at that pet owner demographic. For example, a family in an affluent neighborhood subscribes to the content provider's service. Audio demographic analysis is combined with published demographic data to establish the presence of children in the home in the age range of 12-18. Further, the audio demographic analysis identifies key indicators that a medical professional is present on a consistent basis. Based on this analysis, content providers and advertisers can target this customer based on demographic data which is much more specific and customized to this specific home.

On a specific day, a family has a visitor who happens to bring along their pet Labrador Retriever. The audio demographic analysis returns a pet owner demographic indicator and the event is logged. A company wishing to target their advertisements to pet owners can select households which have logged a pet owner demographic indicator within the previous 30 minutes. Alternatively, another company wishing to target their advertisements to pet owners may opt to bypass this opportunity and only target households that have logged a pet owner demographic for 20 of the past 30 days, even if that indicator was not logged recently, indicating a consistent pet owning audience.

Another embodiment provides a system and method for providing filters to establish an audio demographic analysis database by which audio captured by an audio device in a filter sensor that can be categorized for later reference by other applications. The categorization goes beyond simple source identification or speech recognition to include data points that are useful in determining demographics revealed in the audio, video and infrared data collected. In another embodiment, filters are provided that filter human speech so that speech is analyzed and categorized by tonal qualities. Based on a comparison to a significantly large random sample of a target population, using pitch, a possessor and filter categorize audio identified as human speech by gender and age.

In another embodiment separate filters are provided separately for men, women and children based on tonal quality, vernacular, slang, vocabulary, etc. In another embodiment, filters are also provided that categorize human speech by speech content including vocabulary. Based on a comparison to a significantly large random sample of a target population, processors and filters are configured to create a database of vocabulary which are categorized by age based on the likelihood of those words being used by various age groups. Based on a comparison to a significantly large random sample of a target population, processors create a database of vocabulary words which are categorized by target group based on the likelihood of those vocabulary words being used by various target groups. Using speech recognition technology, filters and post filtering analysis are used to compare the vocabulary of the audio to this reference to categorize the recorded speech by age. Thus, a filter can be used to identify the voice of a man and another filter to identify the man as a Hispanic doctor. Post filtering analysis is performed to identify a profile for the male Hispanic doctor. Using speech recognition technology, an illustrative embodiment provides filters to compare the audio to this reference source to categorize the recorded speech by target group. In another embodiment, filters are provided to analyze human speech by dialect. Based on a comparison to a significantly large random sample of a target population, a database of speech patterns is provided that are specific to the various regional dialects of the target population. Using speech recognition technology, filters or post filtering analysis compares the audio to this reference to categorize the recorded speech by geographical source.

Filters and post filtering analysis are provided to categorize human speech by grammar based on a comparison to a significantly large random sample of a target population. A database of grammar rules and structures is created which categorizes by age based on the likelihood of those grammatical constructs being used by various age groups. Processions use filters and speech recognition technology to compare the audio data to this reference to categorize the recorded speech by age source. Using speech recognition technology and filters, another embodiment compares the audio to a reference source to categorize the recorded speech by nationality. In another embodiment, filters are provided to capture non-human sounds such as animal sounds for categorization and analysis. Based on a comparison to a significantly large random sample of animal sounds, the animal sounds are categorized and the animal audio identified as by species and breed.

In another embodiment, environmental sounds are analyzed. By comparison to a database of known sounds separate and identify sources of common environmental sounds such as aviation, automobile, etc., and categorize sounds by their proximity to such sources, i.e. proximity to an airport, highway. In another embodiment, an audio demographic analyzer processes a random audio signal and returns demographic information based on the analyzed information. For example, a high pitched voice that uses medical terms in the presence of a high pitched barking sound and horns honking, when compared to the statistically collected data might be identified as a 30-40 year old female medical professional, pet owner, city dweller. However a similarly pitched voice that uses terms related to Brittany Spears video might be identified as a 12-18 year old female. Thus, upon identify the audience member, the audience member's responses filtered through a voice print can be chronicled and reported. In another embodiment, targeted advertising can be sent to an identified audience member watching a video data presentation.

In another embodiment, a computer readable medium is disclosed containing a computer program useful for performing a method for estimating an audience reaction to a data stream, the computer program comprising instructions to send a data stream containing filter objects data to a plurality of filtered sensors associated with end user devices; instructions to receive response data from the filtered sensors in response to the data stream in accordance with the filter objects data; and instructions to estimate an audience reaction to the data stream from the response data. In another embodiment of the medium, each of the filter objects data specify a response data sampling start time and duration relative to an event in the data stream, the data stream further comprising data selected from the group consisting of video and audio data.

In another embodiment of the medium, each of the filter objects data have a class selected from the group consisting of man, woman, child, personal and general. In another embodiment of the medium, the computer program further comprising instructions to send general filter object data to the filtered sensors; instructions to collect general response data from the filtered sensors in accordance with the general filter object data; instructions to identify from the general response data at least one audience member associated with at one least filtered sensor; instructions to send personal filter object data to the at least one of the filtered sensors for the at least one audience member co located with the filtered sensor; and instructions to receive response data from the filtered sensor through the personal filter object data in response to the video data for the at least one audience member.

In another embodiment of the medium, the filter objects data comprise regional filter objects data having regional characteristics, received from a regional server, and local filter objects data having local characteristics received from a local server. In another embodiment of the medium, the instructions to send further comprises instructions to send the filter objects to filtered sensors associated with end user devices that have joined a multicast video data stream containing the video data.

In another embodiment of the medium, the multicast join video data stream is served to end user devices associated with the filtered sensors from a digital subscriber access line aggregator multiplexer (DSLAM), the computer program further comprising instructions to identify audience members from the response data received from the filtered sensors; and instructions to send personal filter objects data received from the local server serving video data through the DSLAM to end user devices associated with the filtered sensors. In another embodiment of the medium, the personal filter objects further comprise voice print data, the computer program further comprising instructions to send advertising data to the audience members based on an audience member profile data for the audience member identified by the voice print data. In another embodiment of the medium, computer program further comprises instructions to analyze the response data received from the filtered sensor to determine the audience member's reaction to the data stream.

In another embodiment of the medium, the instructions to estimate further comprise instructions to accumulate reactions for a plurality of end user locations to estimate an audience reaction to the data stream. In another embodiment a system is disclosed for estimating an audience reaction to a data stream, the system comprising but not limited to a processor in data communication with a computer readable medium; and a computer program embedded in the computer readable medium, the computer program comprising instructions to send a data stream containing filter objects data to a plurality of filtered sensors associated with end user devices, instructions to receive response data from the filtered sensors in response to the data stream in accordance with the filter objects data and instructions to estimate an audience reaction to the data stream from the response data.

In another embodiment of the system, each of the filter objects data specify a response data sampling start time and duration relative to an event in the data stream, the data stream further comprising data selected from the group consisting of video and audio data. In another embodiment of the system, each of the filter objects data have a class selected from the group consisting of man, woman, child, personal and general.

In another embodiment of the system, the computer program further comprising instructions to send general filter object data to the filtered sensors; instructions to collect general response data from the filtered sensors in accordance with the general filter object data; instructions to identify from the general response data at least one audience member associated with at one least filtered sensor; instructions to send personal filter object data to the at least one of the filtered sensors for the at least one audience member co located with the filtered sensor; and instructions to receive response data from the filtered sensor through the personal filter object data in response to the video data for the at least one audience member.

In another embodiment of the system, the filter objects data comprise regional filter objects data having regional characteristics, received from a regional server, local filter objects data having local characteristics received from a local server. In another embodiment of the system, the instructions to send further comprise instructions to send the filter objects data to filtered sensors associated with end user devices that have joined a multicast video data stream containing the data stream.

In another embodiment of the system, the multicast join data stream is served to end user devices associated with the filtered sensors from a digital subscriber access line aggregator multiplexer (DSLAM), the computer program further comprising instructions to identify audience members from the response data received from the filtered sensors; and instructions to send personal filter objects data received from the local server serving video data through the DSLAM to the filtered sensors. In another embodiment of the system, the personal filter objects data further comprise voice print data, the computer program further comprising instructions to send advertising data to the audience members based on an audience member profile data for the audience member identified by the voice print data.

In another embodiment of the system, the computer program further comprises instructions to analyze the response data received from the filtered sensor to determine the audience member's reaction to the data stream In another embodiment of the system, the instructions to estimate further comprise instructions to accumulate reactions for a plurality of end user locations to estimate an audience reaction to the data stream.

In another embodiment, a system is disclosed for estimating an audience reaction to a data stream, the system comprising a processor in data communication with a computer readable medium; a filtered sensor in data communication with the processor; and a computer program embedded in the computer readable medium, the computer program comprising instructions to receive a data stream containing filter objects data to the plurality of filtered sensors associated with end user devices, instructions to send response data from the filtered sensors in response to the data stream in accordance with the filter objects data to a server to estimate an audience reaction to the data stream from the response data.

In another embodiment, a computer readable medium is disclosed containing a computer program useful for performing a method for estimating an audience reaction to a data stream, the computer program comprising instructions to receive a data stream containing filter objects data to a plurality of filtered sensors associated with end user devices; instructions to send response data from the filtered sensors in response to the data stream in accordance with the filter objects data to a server to estimate an audience reaction to the data stream from the response data.

Turning now to FIG. 1, in another illustrative embodiment an IPTV system intermediate office (IO) server 114 sends a video data stream 123 comprising television programming content data and filter object data to a filtered sensor device 130. The filtered sensor device is associated with an end-user device set top box 128. The set top box 128 includes a processor 113, memory 115 and database 117. The set top box 128 transfers the video data to an end user device display, which in the present example is a television display 142. The set top box 128 transfers the filter object data to the filtered sensor 130. The filtered sensor provides multiple audio and/or video data sensors 132, 134, 136, 138 and 139. In another embodiment, the video sensors are also infrared sensors. The video and infrared filters use pattern recognition technology to identify audience members gender and age for vide and infrared data. In another embodiment, the video and/or infrared data are correlated with audio data to further refine estimates of audience membership watching a video data presentation.

In another embodiment, IPTV channels of video data are first broadcast as video data comprising video content in an internet protocol from a server at a super hub office (SHO) 102 to a regional or local IPTV video hub office (VHO) server such as VHO 104 or 106, to a central office (CO) server such as CO 108 or 110. The COs transfer the data received from the VHO to an IO such as IO 112, 114, 116, or 118. Filter object data for monitoring audio, infrared and video data at an end user location filtered sensor 130 can be inserted at the SHO, VHO, CO or IO. In another embodiment, general filter object data is inserted at the SHO or VHO, regional filter object data is inserted at the CO and local and personal filter object data is inserted at the IO.

As shown in FIG. 1 an IPTV system includes a hierarchically arranged network of servers wherein the SHO transmits video and advertising data to a video hub office (VHO) end server location close to a subscriber or end user device, such as a CO server 111. The IPTV servers are interconnected via IPTV transport 140 which also provides data communication for Internet and voice over Internet protocol (VoIP) services to subscribers. In an illustrative embodiment, the IPTV transport 140 includes but is not limited to the Internet, satellite and high speed data communication lines including but not limited to fiber optics and digital subscriber lines (DSL).

IPTV channels are video data sent in an Internet protocol (IP) data multicast group to access nodes such as digital subscriber line access multiplexer (DSLAM) 124. In another embodiment, a DSLAM multicasts the video data to end users via a gateway 126. In another embodiment the gateway 126 is a residential gateway (RG). A multicast or unicast for a particular IPTV channel is joined by end user devices such the set-top boxes (STBs) at IPTV subscriber homes from the DSLAM 124. Each SHO, VHO, and CO includes a server 111, processor 113, a memory 115 and a database 117. The IO server delivers IPTV, Internet and VoIP content data.

The television content is delivered via multicast and television advertising data via unicast or multicast depending on a group of end user client subscriber devices which select the television data. In another particular embodiment, end user devices, can include are not limited to, wire line phones, portable phones, lap top computers, personal computers (PC), cell phones, mobile MP3 players communicate with the communication system, i.e., an IPTV network through residential gateway (RG) 126 and high speed communication lines which are shown for an example as IPTV transport 140. In another embodiment, the video and filter object data are delivered over a digital television system. In another embodiment, the video and advertising data are delivered over an analog television system.

Figure 2:
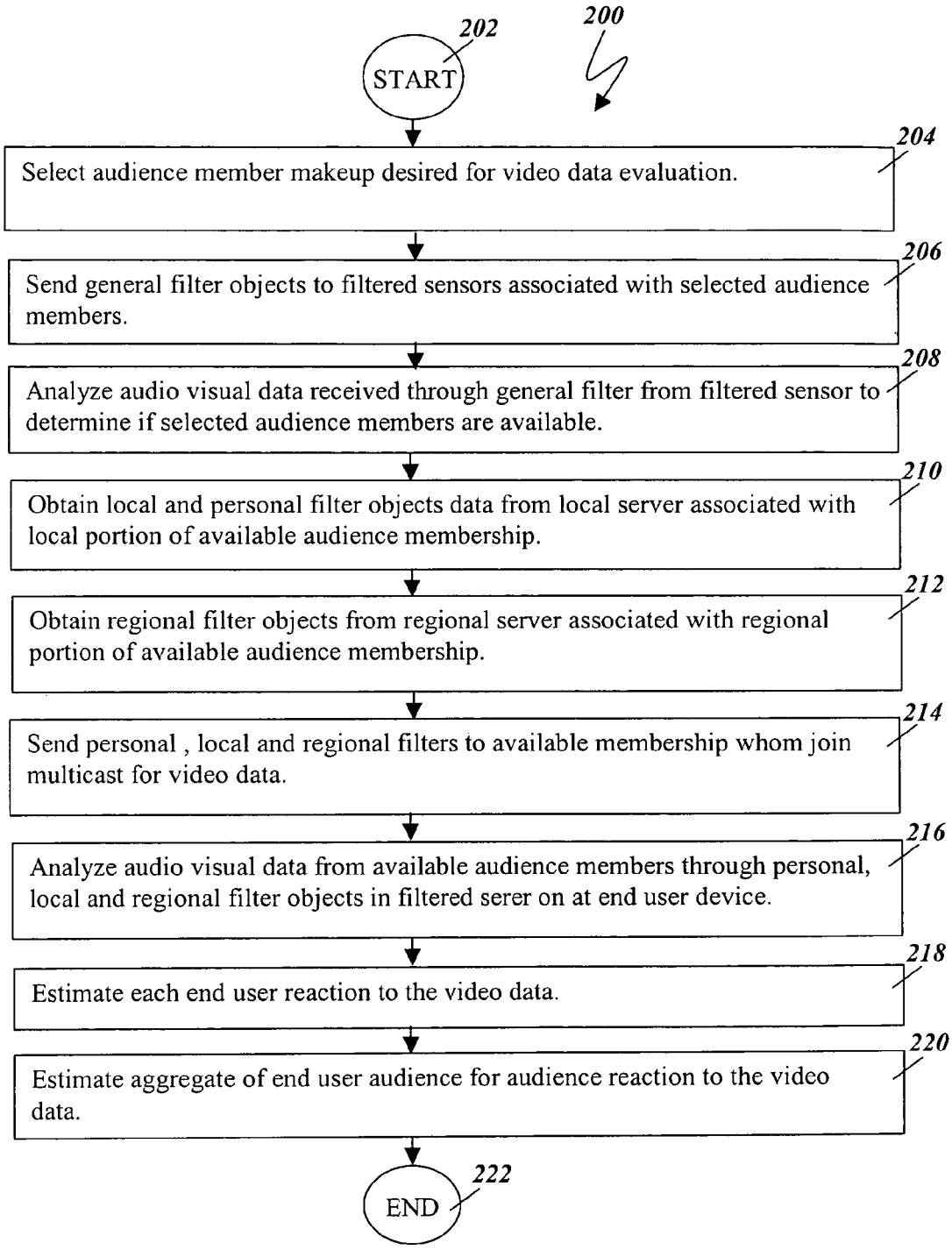
FIG. 2 depicts a flow chart of functions performed in an illustrative method for sending advertising data.

Turning now to FIG. 2, a flowchart of functions performed in another illustrative embodiment is illustrated. A set of functions are performed as shown in FIG. 2. The functions shown in FIG. 2 may be executed in any order and any one or more of the functions can be left out and not executed or rearranged as to order of execution. The flow chart does not represent any mandatory order of execution of any function or that any function must precede another function. The flow chart does not imply that any function shown in the flowchart is mandatory or must be included in any particular embodiment.

As shown in FIG. 2, the flow of functions starts at terminal 202. At block 204 another embodiment selects an audience based on the demographic makeup of the audience. The embodiment determines a demographic distribution of members that makeup a desired audience for a particular video data evaluation. That is, an illustrative embodiment enables a user to select the demographics of the audience for which they wish to estimate an audience reaction to a particular video data. Some users may be interested and select an audience in a male demographic segment for ages 18 to 35 or a female segment ages 25 to 40. In block 206 an illustrative embodiment sends general filter object data to filtered sensors associated with the end user devices for the selected audience members.

In block 208 another illustrative embodiment a VHO, CO or IO server also analyzes audiovisual data received through the general filter object data from the filtered sensor to determine if selected audience members or available. A general filter allows audio, video, visual and infrared data to be received at a VHO, CO or IO server through a filtered sensor device at an end user device to determine the makeup of an audience present at the end user device video data presentation. Another illustrative embodiment analyzes audio, vide and/or infrared data associated with a particular filtered sensor or audience at an end-user to determine the makeup and demographics for the audience. That is an illustrative embodiment can determine that a particular audience is made up of two men and three women and a child watching a particular video data by analyzing audio, video or infrared data received from a filtered sensor.

At block 210 another illustrative embodiment also obtains local and personal filter object data from a local server that serves data to a local portion of an available audience membership of end user devices. At block 212 an illustrative embodiment also obtains regional filter object data from a regional server that serves the video data to a regional portion of an available audience membership. At block 214 another illustrative embodiment also sends the personal local and regional filters to the available members, who have joined a multicast for the video data. At block 216 an illustrative embodiment analyzes audio, video, and infrared data obtained from the filtered center through the personal local and regional filters from the available audience members. At block 218 another illustrative embodiment estimates each available member's reaction to the video data. The filters are selected so that only selected members of an audience watching particular video data are factored into the audience reaction. Thus, if an audience made up of two men, three women and a child watching a video data presentation, another embodiment provides personal filters and gender specific filters to eliminate demand from the audience reaction. Thus, by providing a woman filter and a child filter to the filtered sensor device, only the reaction for the women and children will be sent to the IO server upstream to the CO server and VHO or SHO servers for analysis of their reaction to the video data. At block 220 an illustrative embodiment also estimates an aggregation of it and user audience members for an audience reaction to the video data.

Figure 3:
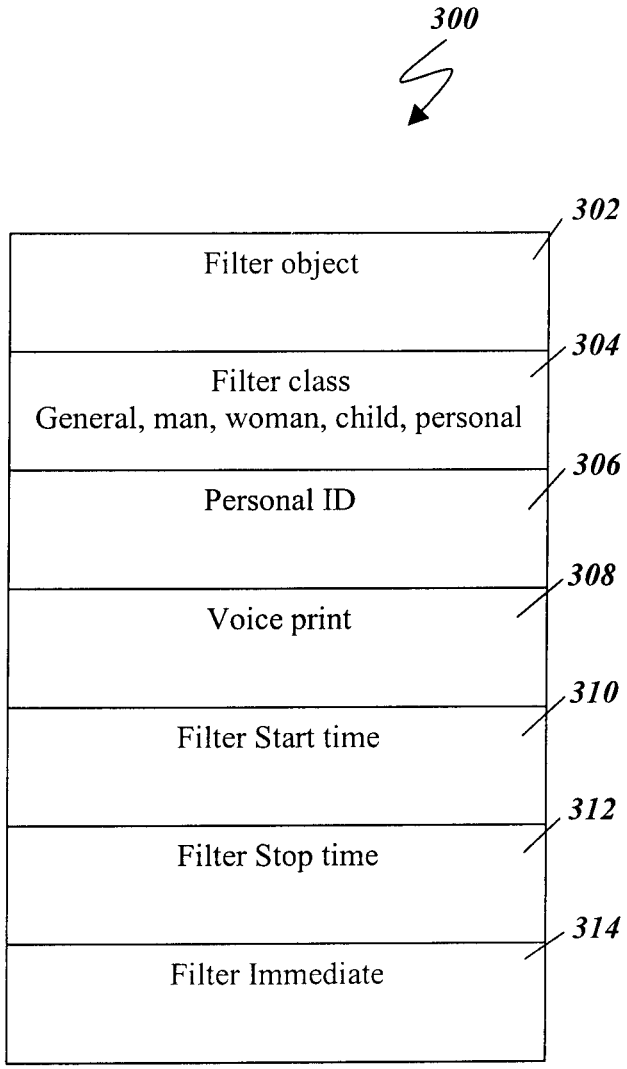
FIG. 3-FIG. 5 depict data structures embedded in a computer readable medium for containing data that are used by a processor and method in a particular illustrative embodiment for evaluating an audience reaction to video data.

Turning now to FIG. 3 a data structure 300 embedded in a computer readable medium such as a memory or database in memory is illustrated for use and an illustrative embodiment of a system and method. A processor is in data communication with the computer readable medium. At block 302 a filter object field is illustrated for containing data indicative of a filter object. At block 304 a filter class field for the filter object is illustrated. They filter class may an include but is not limited to general, man, woman, child, and personal. Specific frequency filter are provided in each filter class so that a filter in a filter class is frequency tuned to filter out all other frequencies and allow passage of selected frequencies to specifically select a frequency band of the voice of a man, woman or child. A general class filter allows all frequencies relevant to the voice of a man, woman or child to pass through the filtered sensor and up to the IO or CO server for analysis.

At block 306 a personal ID field is illustrated for containing data indicative of a personal identifier for a particular audience member. Each identified audience member is assigned a unique personal ID for enabling association of the audience member with an audience member personal profile. At block 308 a voice print field is illustrated for containing data indicative of a voiceprint for the particular end user or audience member identified in the personal ID. At block 310 a filter start time field is illustrated for containing data indicative of a start time for a particular filter object 302. At block 312 a filter stop time field is illustrated for containing data indicative of a filter stop time for filter object 302. At block 314 a filter immediate field is illustrated for containing data indicative of a filter immediate data. The filter start time indicates when the filter object becomes active in relation to a particular video data event, such as 1 second after the punch line of a joke or comedic event presented in the video data presentation. The filter stop time indicates when a particular filter object 302 will stop being active, such as 5 seconds after the punch line.

The filter immediate indicates that the filter object is immediately active and will stop at a filter stop time indicated in block 312. Thus the filters can be selective as to which audience members are monitored for their reaction and as to what times and how often they are monitored. Thus, the filters can be started and stopped to include a reaction to a particular point in the video data. Thus, a punch line to a comedy sequence in a film, video program or advertisement can be synchronized with a filter start and stop time to capture a particular audience members reaction to the comedy segment.

Figure 4:
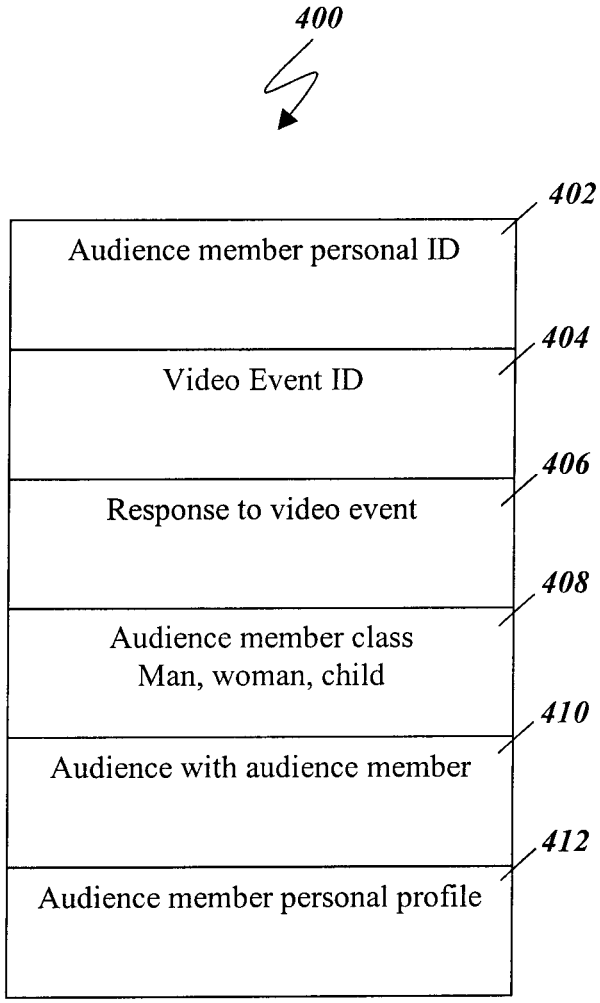

Turning now to FIG. 4, a data structure 400 embedded in a computer readable medium such as a memory or database in memory is illustrated for containing data useful for performing the functions provided by the system and method of a particular illustrative embodiment. At block 402 and audience member personal identifier (ID) field is illustrated for containing a personal ID for a particular audience member. At block 404 a video event ID field is illustrated for containing data indicative of a particular video event for which an audience member 402 identified by the audience member personal ID is being monitored for their reaction to the video event identified in block 404. At block 406, the audience member (identified by personal ID 402) response data (to the video event identified in block 404) are stored. At block 408 and audience member class field is illustrated for containing data indicative of a class for the audience member identified in personal ID 402.

An audience member class may be a man, woman or child class. At block 410 audience members in attendance with the audience member field is illustrated for containing data indicative of an audience with the audience member identified at 402. At block 412 an audience member personal profile field is illustrated for containing data indicative of an audience member personal profile for the audience member identified at 402. And audience member's personal profile can include but is not limited to the audience member's demographic data including age, gender, income, profession, ethnicity and nationality. The audience member personal profile can also include data that indicates the audience member's viewing interests such as sports, music or news and particular programs watched. This information is useful evaluating the audience reaction to video data by demographic as well as to provided targeted advertising to the audience member while the identified audience member is sensed as present in an audience.

Figure 5:
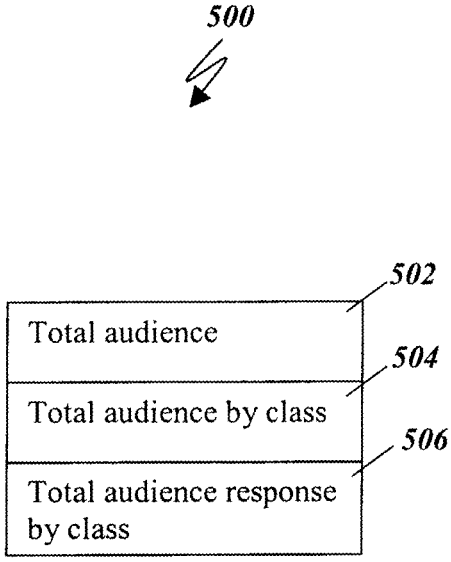

Turning now to FIG. 5, a data structure 500 embedded in a computer readable medium such as a memory or database in memory utilized by the system and method disclosed herein is illustrated. As shown in FIG. 5 a total audience field 502 for containing data indicative of a total audience is illustrated. The total audience indicates a total number of audience members watching a particular video data presentation. As shown at block 504 a total audience by class field is illustrated for containing data indicative of the total audience in each class of audience members. The total audience by class indicates the number of members in the audience categorized by class including but not limited to the number of men, the number of women, and the number of children in the total audience. In another embodiment, additional classes are defined such as Hispanic men, professional women, children with pets, etc. Filters are combined to define the addition classes. As shown in block 506 a total audience response by class field is shown for containing data indicative of a total audience response by each defined class.

Figure 6:
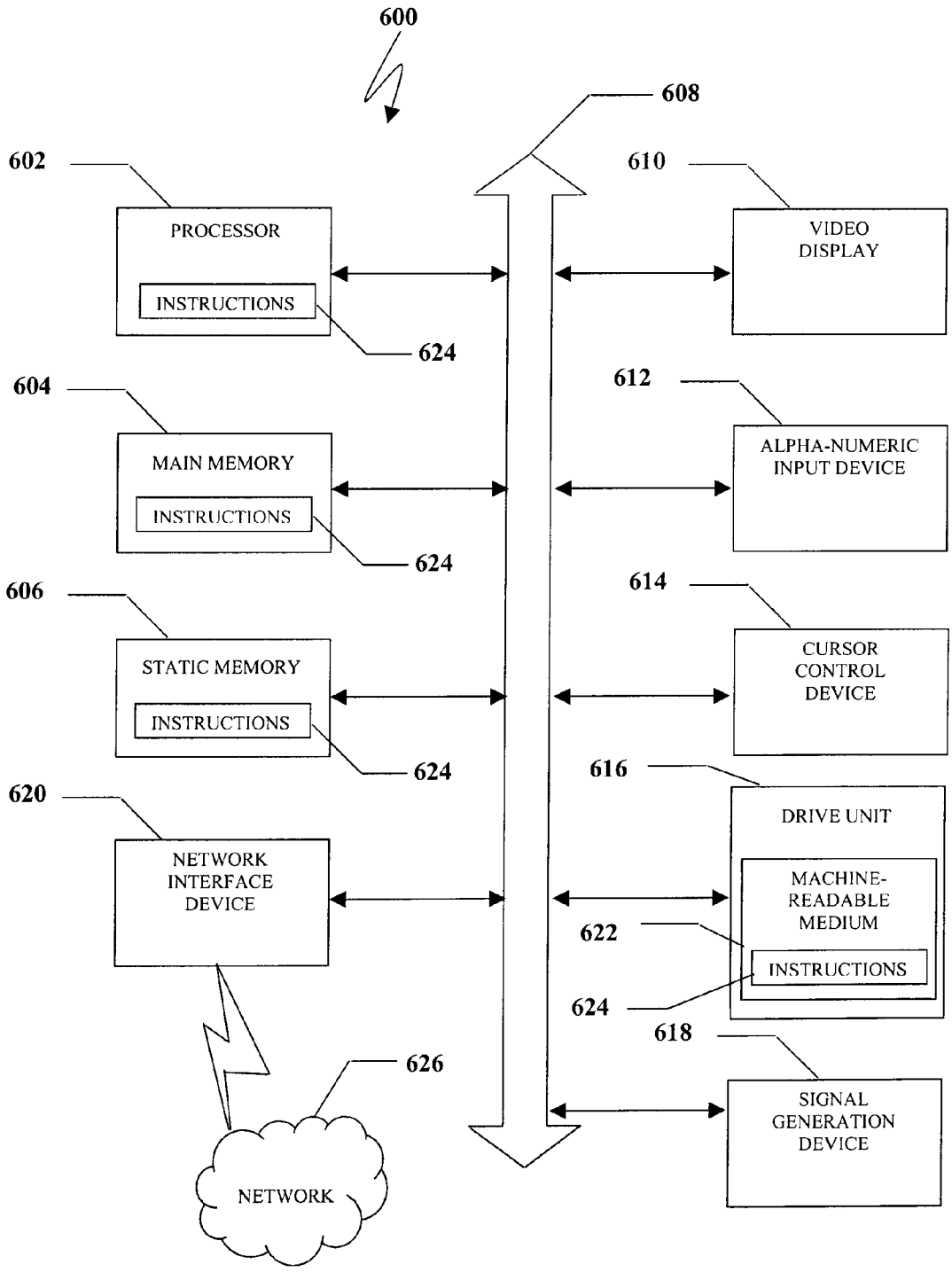
FIG. 6 is illustrates a schematic of a machine for performing functions disclosed in an illustrative embodiment.

Turning now to FIG. 6, FIG. 6 is a diagrammatic representation of a machine in the form of a computer system 600 within which a set of instructions, when executed, may cause the machine to perform any one or more of the methodologies discussed herein. In some embodiments, the machine operates as a standalone device. In some embodiments, the machine may be connected (e.g., using a network) to other machines. In a networked deployment, the machine may operate in the capacity of a server or a client user machine in server-client user network environment, or as a peer machine in a peer-to-peer (or distributed) network environment. The machine may comprise a server computer, a client user computer, a personal computer (PC), a tablet PC, a set-top box (STB), a Personal Digital Assistant (PDA), a cellular telephone, a mobile device, a palmtop computer, a laptop computer, a desktop computer, a communications device, a wireless telephone, a land-line telephone, a control system, a camera, a scanner, a facsimile machine, a printer, a pager, a personal trusted device, a web appliance, a network router, switch or bridge, or any machine capable of executing a set of instructions (sequential or otherwise) that specify actions to be taken by that machine.

It will be understood that a device of the present invention includes broadly any electronic device that provides voice, video or data communication. Further, while a single machine is illustrated, the term "machine" shall also be taken to include any collection of machines that individually or jointly execute a set (or multiple sets) of instructions to perform any one or more of the methodologies discussed herein.

The computer system 600 may include a processor 602 (e.g., a central processing unit (CPU), a graphics processing unit (GPU), or both), a main memory 604 and a static memory 606, which communicate with each other via a bus 608. The computer system 600 may further include a video display unit 610 (e.g., liquid crystals display (LCD), a flat panel, a solid state display, or a cathode ray tube (CRT)). The computer system 600 may include an input device 612 (e.g., a keyboard), a cursor control device 614 (e.g., a mouse), a disk drive unit 616, a signal generation device 618 (e.g., a speaker or remote control) and a network interface.

The disk drive unit 616 may include a machine-readable medium 622 on which is stored one or more sets of instructions (e.g., software 624) embodying any one or more of the methodologies or functions described herein, including those methods illustrated in herein above. The instructions 624 may also reside, completely or at least partially, within the main memory 604, the static memory 606, and/or within the processor 602 during execution thereof by the computer system 600. The main memory 604 and the processor 602 also may constitute machine-readable media. Dedicated hardware implementations including, but not limited to, application specific integrated circuits, programmable logic arrays and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the present invention, the methods described herein are intended for operation as software programs running on a computer processor. Furthermore, software implementations can include, but not limited to, distributed processing or component/object distributed processing, parallel processing, or virtual machine processing can also be constructed to implement the methods described herein.

The present invention contemplates a machine readable medium containing instructions 624, or that which receives and executes instructions 624 from a propagated signal so that a device connected to a network environment 626 can send or receive voice, video or data, and to communicate over the network 626 using the instructions 624. The instructions 624 may further be transmitted or received over a network 626 via the network interface device 620. The machine readable medium may also contain a data structure for containing data useful in providing a functional relationship between the data and a machine or computer in an illustrative embodiment of the disclosed system and method.

While the machine-readable medium 622 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that cause the machine to perform any one or more of the methodologies of the present invention. The term "machine-readable medium" shall accordingly be taken to include, but not be limited to: solid-state memories such as a memory card or other package that houses one or more read-only (non-volatile) memories, random access memories, or other re-writable (volatile) memories; magneto-optical or optical medium such as a disk or tape; and carrier wave signals such as a signal embodying computer instructions in a transmission medium; and/or a digital file attachment to e-mail or other self-contained information archive or set of archives is considered a distribution medium equivalent to a tangible storage medium. Accordingly, the invention is considered to include any one or more of a machine-readable medium or a distribution medium, as listed herein and including art-recognized equivalents and successor media, in which the software implementations herein are stored.

Although the present specification describes components and functions implemented in the embodiments with reference to particular standards and protocols, the invention is not limited to such standards and protocols. Each of the standards for Internet and other packet switched network transmission (e.g., TCP/IP, UDP/IP, HTML, and HTTP) represent examples of the state of the art. Such standards are periodically superseded by faster or more efficient equivalents having essentially the same functions. Accordingly, replacement standards and protocols having the same functions are considered equivalents.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A non-transitory computer readable medium containing a computer program comprising instructions that when executed by a computer estimate an audience reaction to a data stream, the computer program comprising:

instructions to send a video content data stream containing video content data to an end user device;

instructions to send general filter object data to the end user device;

instructions to receive audio, video, visual and infrared data from the end user device filtered through the general filter object data to select a demographic segment of an audience watching the video content data stream at the end user device, based on the audio, video, visual and infrared data filtered through the general filter object data and compared to a pitch and vocabulary of members voices filtered through the general filter object data;

instructions to identify a particular audience member from the demographic segment of the audience based on a comparison of the audio data to a voice print for the particular audience member;

instructions to send to the end user device, voice print data for the particular audience member; and instructions to receive response data filtered through the voice print data wherein the voice print indicates that the response is from the particular audience member in response to the video content data stream.

2. The medium of claim 1, wherein the general filter object data and personal filter object data specify a response data sampling start time and duration relative to an event in the video content data stream, the video content data stream further comprising video data; the computer program further comprising: instructions to receive environmental audio data from the end user device to determine a locality for the end user device; and instructions to send advertising data to the end user device based on the environmental audio.

3. The medium of claim 2, wherein each of the general filter object data has gave a class of man, wherein the class indicates the general filter object data to detect a member of the class, wherein the environmental audio data indicates a locality for the end user device.

4. The medium of claim 2, wherein the environmental audio data indicates pet ownership by an audience member;

the computer program further comprising: instructions to send a pet advertisement to the audience member with pet ownership;

instructions to receive response data from the audience viewing the video data at the end user device filtered sensor through a first personal filter object data in response to the video content data for a first audience member; instructions to receive response data from a second personal filter object data in response to the video content data for a second audience member; and instructions to estimate a reaction for the first audience member to the video content data at a first time and a reaction for the second audience member to video content data at a second time.

5. The medium of claim 4, the computer program further comprising:

instructions to estimate a reaction for the first audience member to the video content at the first time in the video content data and instructions to estimate a reaction for the second audience member to video content data at a second time, wherein the video content at the first time and the video content at the second time are different.

6. The medium of claim 5, wherein the instructions to send further comprise instructions to send the general filter object data to filtered sensors associated with end user devices that have joined a multicast video data stream containing the video data.

7. The medium of claim 6, wherein the multicast join video data stream is served to end user devices associated with the filtered sensors from a digital subscriber access line aggregator multiplexer (DSLAM), the computer program further comprising:

instructions to send personal filter objects data received from a local server serving video data through the DSLAM to end user devices associated with the end user device.

8. The medium of claim 7, wherein the personal filter object data further comprise the voice print data, the computer program further comprising: instructions to send advertising data to the audience based on an audience member profile data for an audience member identified by the voice print data.

9. The medium of claim 7, the computer program further comprising: instructions to analyze the response data to determine the particular audience member's reaction to the data stream.

10. The medium of claim 9, the computer program further comprising: instructions to accumulate reactions for a plurality of end user locations to estimate the audience reaction to the data stream.

11. A system for estimating an audience reaction to a data stream, the system comprising:

a processor in data communication with a tangible computer readable medium; and a computer program embedded in the computer readable medium, the computer program comprising instructions to send a video content data stream containing video content data to an end user device;

instructions to receive audio, video, visual and infrared data from the end user device filtered through the general filter object data to select a demographic segment of an audience watching the video content data stream at the end user device, based on the audio, video, visual and infrared data filtered through the general filter object data and compared to a pitch and vocabulary of members voices filtered through the general filter object data;

instructions to identify a particular audience member from the demographic segment of the audience based on a comparison of the audio data to a voice print for the particular audience member;

instructions to send to the end user device, voice print data for the particular audience member; and instructions to receive response data filtered through the voice print data wherein the voice print indicates that the response is from the particular audience member in response to the video content data stream.

12. The system of claim 11, wherein the general filter object data and personal filter object data specify a response data sampling start time and duration relative to an event in the video content data stream, the video content data stream further comprising video data; the computer program further comprising: instructions to receive environmental audio data from the end user device to determine a locality for the end user device; and instructions to send advertising data to the end user device based on the environmental audio.

13. The system of claim 12, wherein each of the general filter object data has gave a class of man, wherein the class indicates the general filter object data to detect a member of the class, wherein the environmental audio data indicates a locality for the end user device.

14. The system of claim 12, wherein the environmental audio data indicates pet ownership by an audience member;

the computer program further comprising: instructions to send a pet advertisement to the audience member with pet ownership;

instructions to receive response data from the audience viewing the video data at the end user device filtered sensor through a first personal filter object data in response to the video content data for a first audience member; instructions to receive response data from a second personal filter object data in response to the video content data for a second audience member; and instructions to estimate a reaction for the first audience member to the video content data at a first time and a reaction for the second audience member to video content data at a second time.

15. The system of claim 14, instructions to estimate a reaction for the first audience member to a first time in the video content data and instructions to estimate a reaction for the second audience member to a second time in the video content data, wherein the video content at the first time and the video content at the second time are different.

16. The system of claim 11, wherein the instructions to send further comprise instructions to send the general filter object data to filtered sensors associated with end user devices that have joined a multicast video data stream containing the video data.

17. The system of claim 16, wherein the multicast join data stream is served to end user devices associated with the filtered sensors from a digital subscriber access line aggregator multiplexer (DSLAM), the computer program further comprising:

instructions to send personal filter objects data received from a local server serving video data through the DSLAM to end user devices associated with the end user device.

18. The system of claim 17, wherein the personal filter object data further comprise the voice print data, the computer program further comprising: instructions to send advertising data to the audience based on an audience member profile data for an audience member identified by the voice print data.

19. A system for estimating an audience reaction to a data stream, the system comprising:

a computer in data communication with a tangible non-transitory computer readable medium;

a filtered sensor in data communication with the processor at an end user device; and a computer program embedded in the computer readable medium, the computer program comprising instructions to send audio, video, visual and infrared data from the end user device filtered through the general filter object data to select a demographic segment of an audience watching the video content data stream at the end user device, based on the audio, video, visual and infrared data filtered through the general filter object data and compared to a pitch and vocabulary of members voices filtered through the general filter object data;

instructions to identify a particular audience member from the demographic segment of the audience based on a comparison of the audio data to a voice print for the particular audience member;

instructions to receive at the end user device, voice print data for the particular audience member; and instructions to send response data filtered through the voice print data wherein the voice print indicates that the response is from the particular audience member in response to the video content data stream.

* * * * *